US008496566B2

(12) United States Patent
Casadei

(10) Patent No.: US 8,496,566 B2
(45) **Date of Patent: *Jul. 30, 2013**

(54) REGULATING MEMBER

(75) Inventor: Marco Casadei, Montecolombo (IT)

(73) Assignee: Technogym S.p.A., Gambettola (FC) (IT)

( * ) Notice: Subject to any disclaimer, the term of this patent is extended or adjusted under 35 U.S.C. 154(b) by 296 days.

This patent is subject to a terminal disclaimer.

(21) Appl. No.: 13/005,750

(22) Filed: Jan. 13, 2011

(65) Prior Publication Data

US 2011/0172070 A1 Jul. 14, 2011

(30) Foreign Application Priority Data

Jan. 14, 2010 (IT) ..... RA2010A0002

(51) Int. Cl.
*A63B 21/00* (2006.01)

(52) U.S. Cl.
USPC ..... 482/99; 482/102; 482/98

(58) Field of Classification Search
USPC ..... 482/94, 99, 103, 98, 102
See application file for complete search history.

(56) References Cited

U.S. PATENT DOCUMENTS 5,273,506 A 12/1993 Dawson
8,096,926 B1 * 1/2012 Batca ..... 482/99
2002/0039954 A1 * 4/2002 Simonson ..... 482/99
2004/0192519 A1 9/2004 Slawinski
2005/0202941 A1 * 9/2005 Vaes ..... 482/94
2007/0179030 A1 8/2007 Slawinski
2009/0170668 A1 7/2009 Giannelli
2009/0170669 A1 * 7/2009 Giannelli et al. ..... 482/103

OTHER PUBLICATIONS

European Search Report dated Sep. 29, 2010.

* cited by examiner

*Primary Examiner* — Jerome W Donnelly
(74) *Attorney, Agent, or Firm* — Abelman, Frayne & Schwab

(57) ABSTRACT

Regulating member (1) carried by an operating unit (100) provided with a frame (10) coupled in a slidable manner to a support member (M); the regulating member (1) comprising a handle (2) suitable to move the frame (10) relative to the support member (M); a blocking device (70) comprising a pin (72) movable between an engagement position (PI) and a regulating position (PR) transversally to the support member (M) to connect the frame (10) to the support member (M) in a longitudinal position definable at will; a switching member (76) being hinged to the first pin (72) to move it between the engagement position (PI) and the regulating position (PR); the handle (2) being connected rigidly to the switching member (76) to actuate the pin (72) transversally to the support member (M) and move the frame (10) along the support member (M) with the pin (72) arranged in the regulating position (PR).

25 Claims, 4 Drawing Sheets

REGULATING MEMBER

FIELD OF THE INVENTION

The present invention relates to a regulating member. In particular, the present invention relates to a regulating member for an operating unit provided with a user interface prismatically coupable to an elongated member. In more detail, the present invention relates to a regulating member for an operating unit provided with a user interface prismatically coupable to an elongated member in a position definable at will.

BACKGROUND TO THE INVENTION

In the field of gymnastic machines it is known to use at least one elongated member, usually an upright produced by extrusion, to carry an operating unit in a freely longitudinally slidable and selectively fixed manner. To fix this operating unit in a given operating position the use is well known of a regulating member, usually provided with a pin suitable to engage transversally the elongated member, for example in one hole of a plurality of holes obtained transversally in the upright. A blocking device is usually associated with the pin, and this latter presents an its own first end adequately shaped to engage stably one of the holes described above. Each pin presents, at opposite side from this first end, a head accessible by a user and usable to switch the position of the pin from the position of engagement of a hole of the upright to a release position, that allows to update the longitudinal position of the return unit along the upright. An example is shown in the patent document US20090170668 which discloses a gymnastic machine equipped with at least an operative unit provided with a handle and carried in slidable manner along a respective upright associated to the frame of the gymnastic machine itself. In particular, each operative unit of the machine according to document '668 is equipped with a respective blocking device suitable, in use, to selectively retain the position of the operative unit along the respective upright. In more details, the blocking device disclosed in the document '688 comprises a locking pin which, in use, is stably maintained by a spring in engagement of one of the holes made in the respective upright. In view of the above description, the regulating members provided with the blocking devices described above require the use of one hand to extract the pin from a corresponding hole of the upright and to maintain it separated from the upright to allow the longitudinal displacement of the unit, and the use of the other hand to perform at the same time this displacement.

It is clearly apparent that, in some low-automated sectors, wherein the operator must execute different and substantially contemporaneous tasks, the contemporaneous use of both the hands could be excessively onerous for the operator, at least due to the fact that the two tasks to be performed are complementary and intended for different activities. As shown above, with reference to patent document '668, the same problem exists also in the sector of the gymnastic machines, for example for adjusting the position of a seat or of a return member relative to the respective upright. In particular, taking into account the multi-station machines, wherein more users can train contemporaneously, occupying very near and sometimes shared spaces due to the particular conformation of these machines. In these cases, the users occupying contemporaneously spaces as those described above could hinder each other, and therefore the goal of optimising the exploitation of the space available in the gyms to maximise the hourly number of attendees could not be effectively achievable.

It is therefore appropriate to re-examine the way of using the return units associated with uprights in a slidable manner so as to change the conformation thereof in order to solve and possibly to overcome the drawbacks described above. It is clearly understood that this allows defining a new standard for the construction of return units and of machines provided with these return units, that are particularly practical to be used and, moreover, economical and safe.

SUMMARY OF THE INVENTION

The present invention relates to a regulating member. In particular, the present invention relates to a regulating member for an operating unit provided with a user interface prismatically coupable to an elongated member. In more detail, the present invention relates to a regulating member for an operating unit provided with a user interface prismatically coupable to an elongated member in a position definable at will.

An object of the present invention is to provide a regulating member that allows the disadvantages illustrated above to be solved, which is practical in use and economical, and which is suitable to satisfy a plurality of requirements that to date have still not been addressed, capable to represent a new and original source of economic interest.

According to the present invention, a regulating member is provided, whose main characteristics will be described in at least one of the appended claims.

A further object of the present invention is to provide an operating unit coupled with an elongated member in a slidable manner and provided with this regulating member.

According to the present invention an operating unit is provided coupled with an elongated manner in a slidable manner and provided with this regulating member, and the main characteristics of the operating unit will be described in at least one of the appended claims.

A further object of the present invention is to provide a gymnastic machine provided with this operating unit, which allows to solve the drawbacks illustrated above, is practical in use and economical, and which is suitable to satisfy a plurality of requirements that to date have still not been addressed, capable to represent a new and original source of economic interest.

According to the present invention a gymnastic machine is provided, provided with this operating unit and the main characteristics of this gymnastic machine will be described in at least one of the appended claims.

BRIEF DESCRIPTION OF DRAWINGS

Further characteristics and advantages of the regulating member, of the operating unit including this regulating member and of the gymnastic machine including this operating unit according to the present invention will be more apparent from the description below, set forth with references to the accompanying drawings, that illustrate at least one non-limiting example of embodiment, wherein identical or corresponding parts are identified by the same reference numbers. In particular.

DETAILED DESCRIPTION OF THE INVENTION

Figures 1, 2:
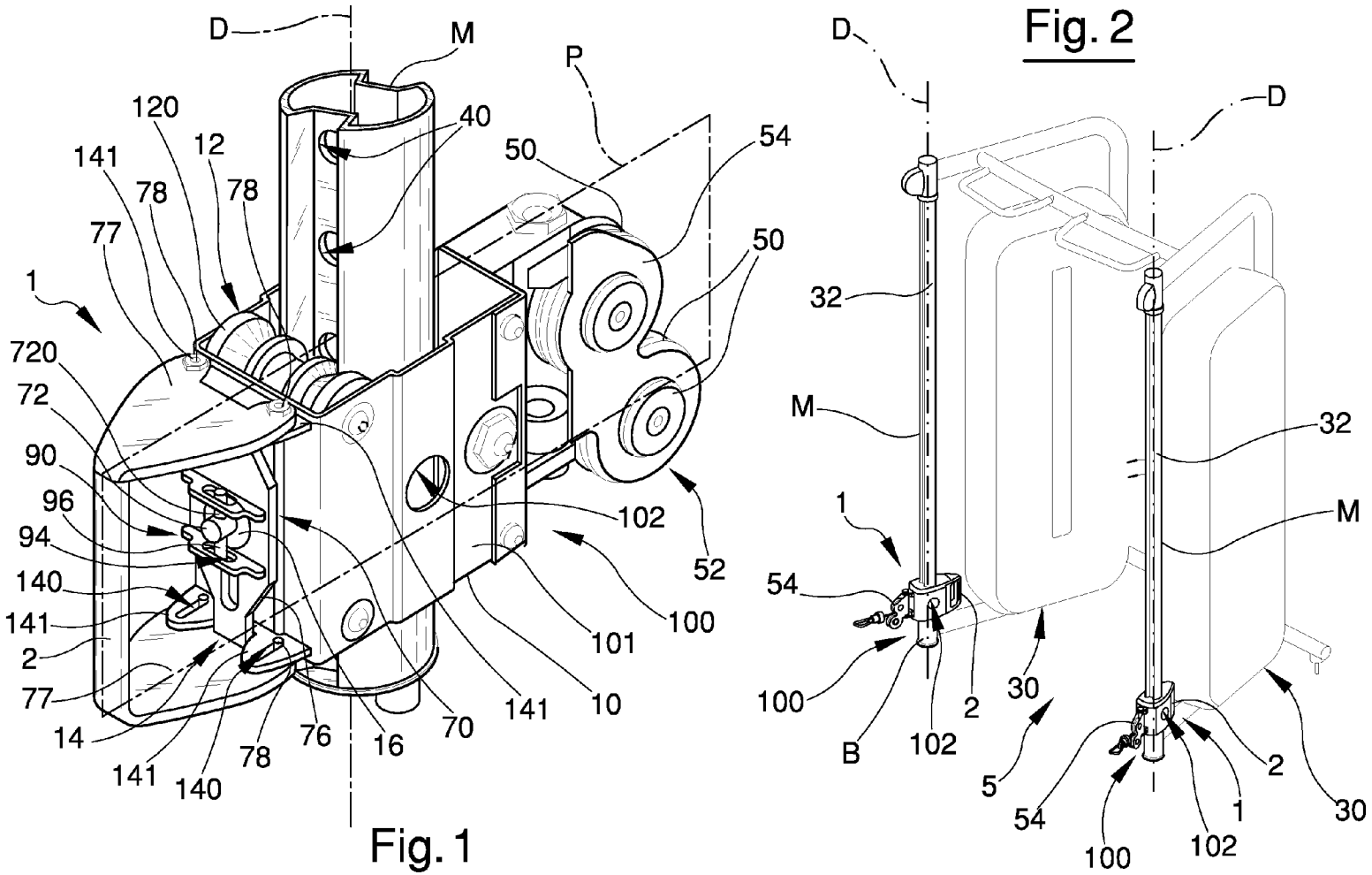
FIG. 1 is a schematic perspective view of a first preferred embodiment of a regulating member with some parts removed from the sake of clarity, produced through the teachings of the present invention.
FIG. 2 is a schematic perspective view of a gymnastic machine provided with the regulating member of FIG. 1.

In FIG. 1, number 1 indicates, in its entirety, a regulating member for an operating unit 100 of a machine 5 (FIG. 2) provided with a base B supporting a load group 30 actuatable through a flexible member wound around a plurality of pulleys 50. The machine 5 comprises a substantially rectilinear elongated member M, generally called upright and carried rigidly by the base B along a given direction D, substantially vertical in FIG. 2. It should be noted that the upright M can also present a curvature of the respective longitudinal axis, without however modifying the protective scope of the present invention. In addition, for the sake of practicality and without limiting the protective scope of the present invention, the machine through which an embodiment of the present invention is illustrated is of the type usable for the execution of gymnastic exercises visible only in FIG. 2, and, obviously provided with at least one upright M. In this case, as it will be better explained below, the operating unit 100 supports a plurality of pulleys 50 and it comprises therefore a return unit 100. In other cases, as it will be better explained hereunder, different devices can be associated with the operating unit, without however limiting the protective scope of the present invention. If it is deemed necessary, reference can be therefore made directly to a return unit 100 instead of making reference generically to an operating unit 100, without generating misunderstandings or obstacles to the comprehension of the scope of the present invention.

With reference to FIG. 1, the return unit 100 comprises a frame 10 coupled to the upright M in a substantially prismatic manner through a guiding device 12. The frame 10 comprises a box body 101 of substantially annular shape and of sufficient dimensions to contain the upright M. The box body 101 presents laterally at least one transverse opening 102, whose aim will be more apparent below. The frame 10 supports at the rear in FIG. 1 a return device 52 provided with at least one pulley 50. In particular, this return device 52 comprises a box body 54 carrying at least one pulley 50 in a freely rotatable manner to return a flexible member 32 and is supported by the frame 10 in a tiltable manner around an axis substantially parallel to the given direction D. In this way the return device 52 allows following displacements of the traction action exerted through the corresponding flexible member 32 on the load group 30 during a training made by a user.

With reference to FIG. 1 again, the regulating member 1 comprises a handle 2 supported by the frame 10 at opposite side from the return device 52, as it will be better described below, and can be used to move the return member 50 along the upright M.

With particular reference to FIGS. 1, 3, 4, and 5, the regulating member 1 comprises a blocking device 70 carried by the frame 10 to fix stably the frame 10 to the upright M in a longitudinal position definable at will. This blocking device 70 comprises a first pin 72 transversally movable relative to the upright M against the action of a spring 74 from and towards an engagement position with the upright M, in a respective hole of a plurality of holes 40 shown in FIG. 1. The blocking device 70 furthermore presents a switching member 76 carried by the frame 10 in a tiltable manner, as it will be better explained below, to actuate the first pin 72 relative to the upright M, and the handle 2 is connected rigidly to the switching member 76 so as to be suitable to actuate the first pin 72 in a tiltable manner relative to the frame 10 contextually to the longitudinal movement of the frame 10. This switching member 76 embodies the handle 2 through two respective projections 77, that delimit it transversally relative to the upright M.

To go back to what disclosed above, the regulating member 1 comprises a constraining group 14 to couple the switching member 76 to the frame 10. In particular, the constraining group 14 comprises at least one pair of slots 140, four in the version of the attached figures, each of which is obtained in a bracket 141 carried rigidly by the frame 10 at opposite side from the return device 52. The four brackets 141 are arranged at the vertices of an ideal quadrilateral arranged symmetrically relative to the median plane P.

The constraining group 14 furthermore comprises a second pin 78 carried integrally by the switching member 76 in a symmetric position relative to a longitudinal median plane P of the frame 10, visible only in FIG. 1, where it has been drawn as a rectangular with a dot-dashed line. Each slot 140 houses a second pin 78 transversally. It is useful to specify that each slot 140 presents a substantially round shape and is arched similarly to a distance between the two second pins 78, so that each second pin 78 is suitable to define selectively a centre of rotation for rotating the switching member 76 relative to the frame 10. The first pin 72 furthermore presents a first longitudinal portion 720 suitable to act as a longitudinal guide for the spring 74 at the side of the switching member 76, and a second longitudinal portion 722 with cross section increased relative to said first portion 720 and delimited longitudinally by a free end portion 724 suitable to engage anyone of the holes 40 of the upright M. This second longitudinal portion 722 is therefore suitable to act as an abutment for the spring 74 carried by the first portion 720 at opposite side from the switching member 76.

Figure 3:
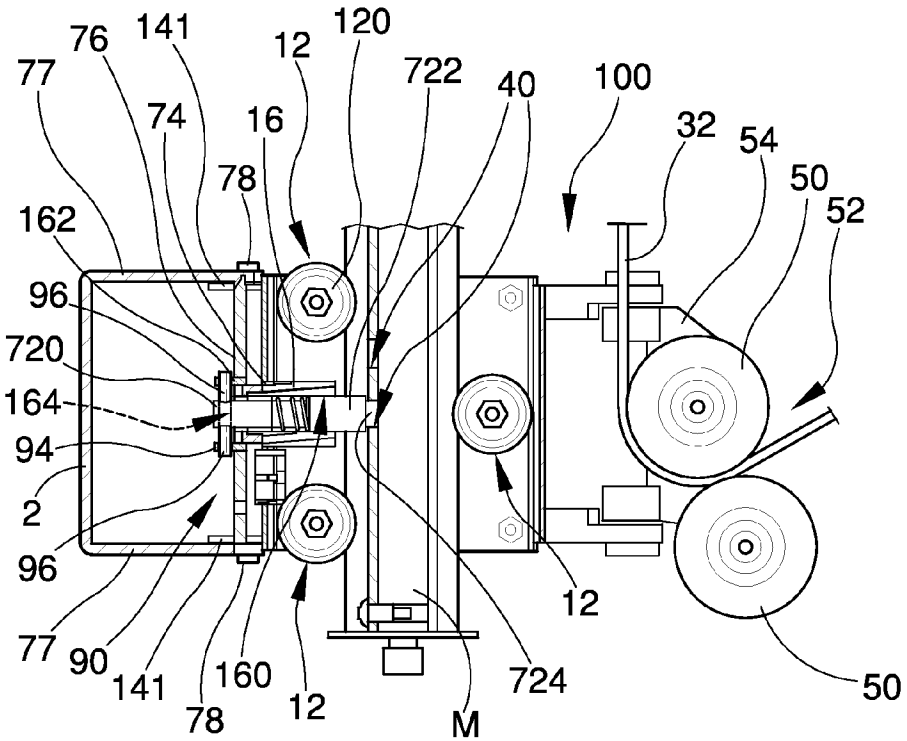
FIG. 3 is a side elevation view of FIG. 1 in enlarged scale and with some parts removed for the sake of clarity.
Figure 5:
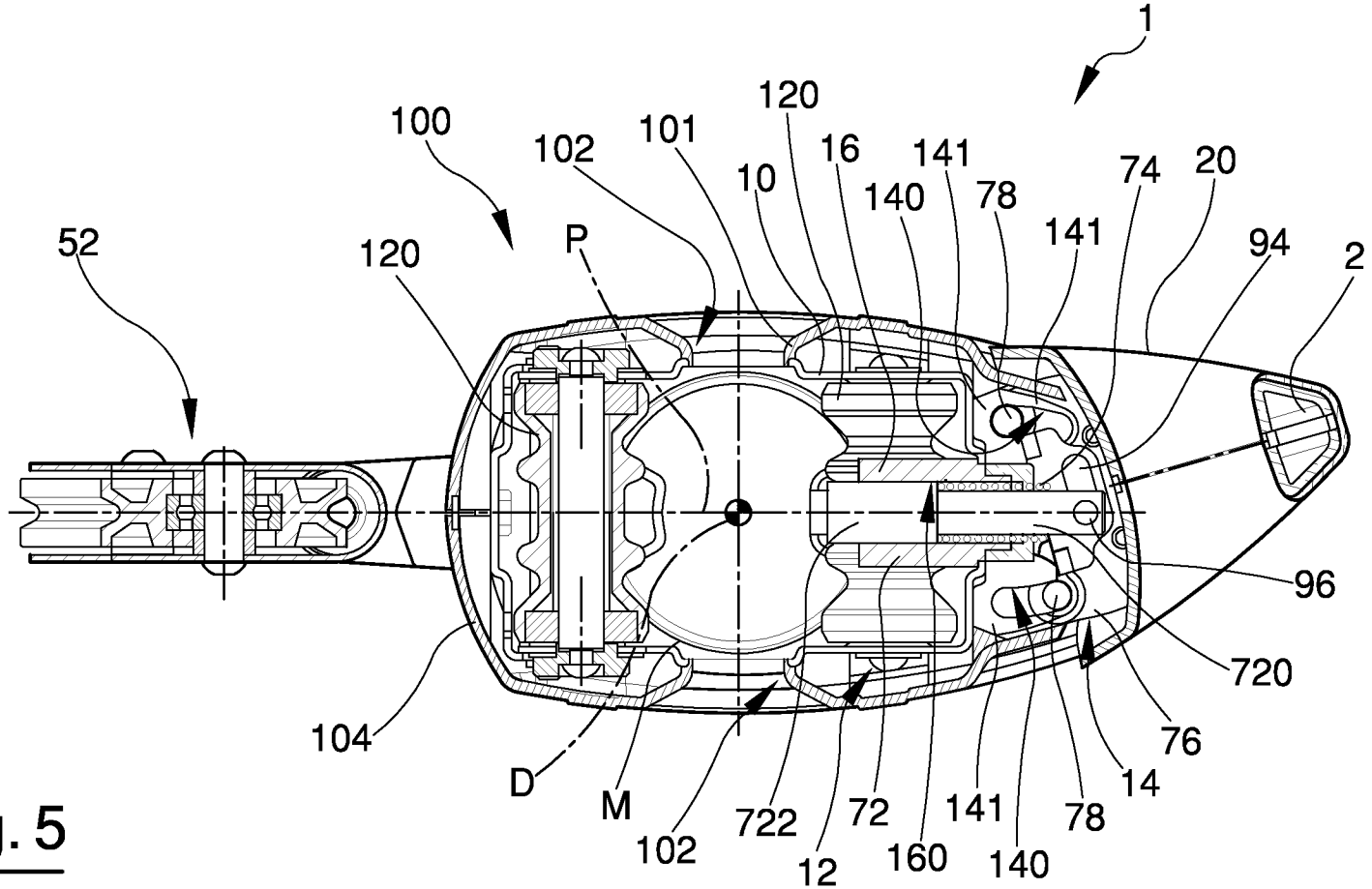
FIG. 5 is a plan view of FIG. 4 in enlarged scale, partially cut away and with some parts removed for the sake of clarity in a particular operating condition.

According to the FIGS. 3 and 5, the frame 10 supports a sleeve 16 arranged at the side of the switching member 76 transversally to the upright M; the sleeve 16 is provided with a through longitudinal seat 160 dimensioned so as to house longitudinally the first portion 720 of the first pin 72 supporting the spring 74. The sleeve 16 furthermore presents, at the side of the switching member 76, an abutment member comprising a disc 162 provided with a first hole 164 with cross section slightly greater than the transversal dimension of the first portion 720 and slightly less than a cross section of the spring 74. In view of the above description, the sleeve 16 is suitable to be selectively crossed by the first portion 720 of the first pin 72 and axially to constrain the spring 74 at the side of the switching member 76.

The regulating member 1 comprises a coupling member 90 provided with a second hole 92 obtained in the first portion 720 of the first pin 720 and of at least one slit 94 transversally associated with the switching member 76 in a position substantially symmetrical to the median plane P of the frame 10. The coupling group 90 furthermore comprises a key member 96 arranged transversally to the first pin 72 and engaging each slit 94 to connect stably the switching member and the first pin 72. The switching member 76 and the first portion 720 are therefore mechanically connected to each other in a freely rotatable manner around a common axis of rotation, constrained to lie on the median plane P of the frame 10.

With reference to FIG. 3, the guiding device 12 comprises a plurality of roller-shaped members 120 carried by the frame 10 transversally to the median plane P. The upright M presents a prismatic shape and each roller-shaped member 120 is shaped longitudinally to couple transversally with the upright M in a substantially conjugated manner. These roller-shaped members 120 are carried by the frame 10 according to a triangle arrangement, so as to maintain the frame 10 constantly transverse to the upright M.

It should be specified that the transverse opening 102 of the frame 10 is obtained between the roller-shaped members 120 to make visible a side central portion of the upright M that can have metric notches or other useful signs for regulating the position of the frame 10, and therefore of the return unit 100, on the upright M.

Figure 4:
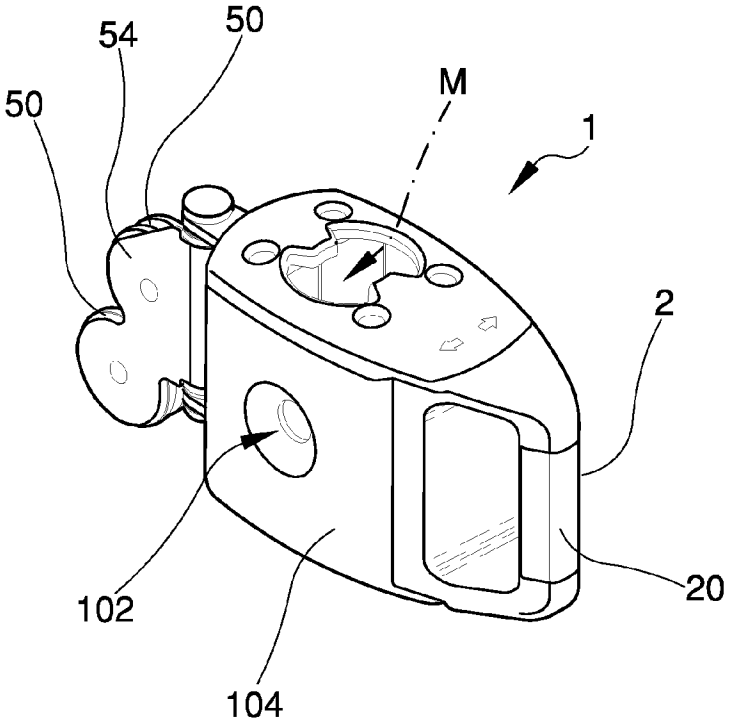
FIG. 4 is a schematic perspective view of FIG. 1.

Obviously, the regulating member 1 can comprises or not, according to the project requirements, an external shell 22 covering at least partially the handle 2 and an external shell 104 covering externally the frame 10, as shown in FIG. 4.

The use of the regulating member 1, of the return unit 100 and of the gymnastic machine 5 described above is easily understood from the description above and does not require further explanation.

Lastly, it is apparent that modifications and variants can be made to the regulating member 1, to the unit 100 and to the gymnastic machine 5 described and illustrated herein, without however departing from the protective scope of the present invention.

Figure 7:
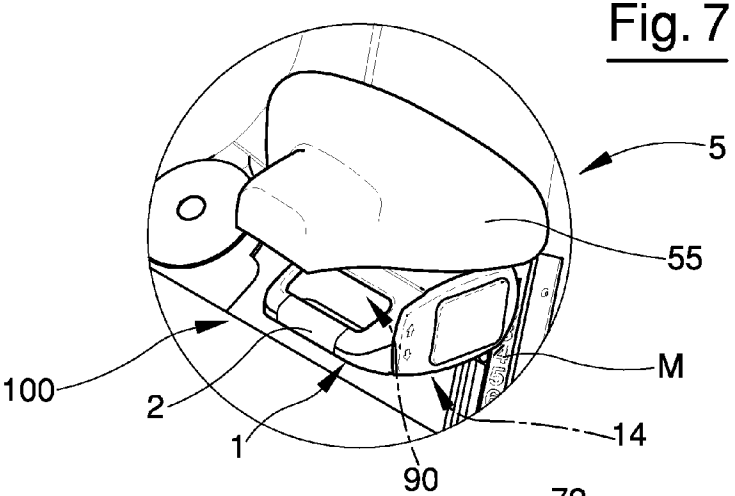
FIG. 7 is a schematic perspective view of a detail extracted from FIG. 6, in enlarged scale and with some parts removed for the sake of clarity.
Figure 8:
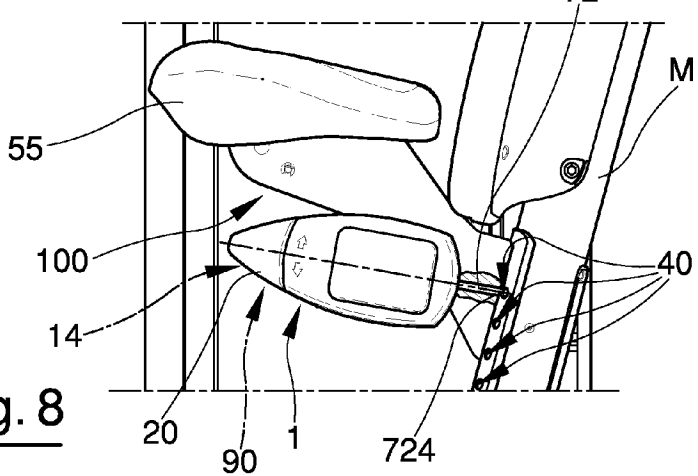
FIG. 8 is a view in enlarged scale and with some parts removed for the sake of clarity of a detail extracted from FIG. 6.
Figure 6:
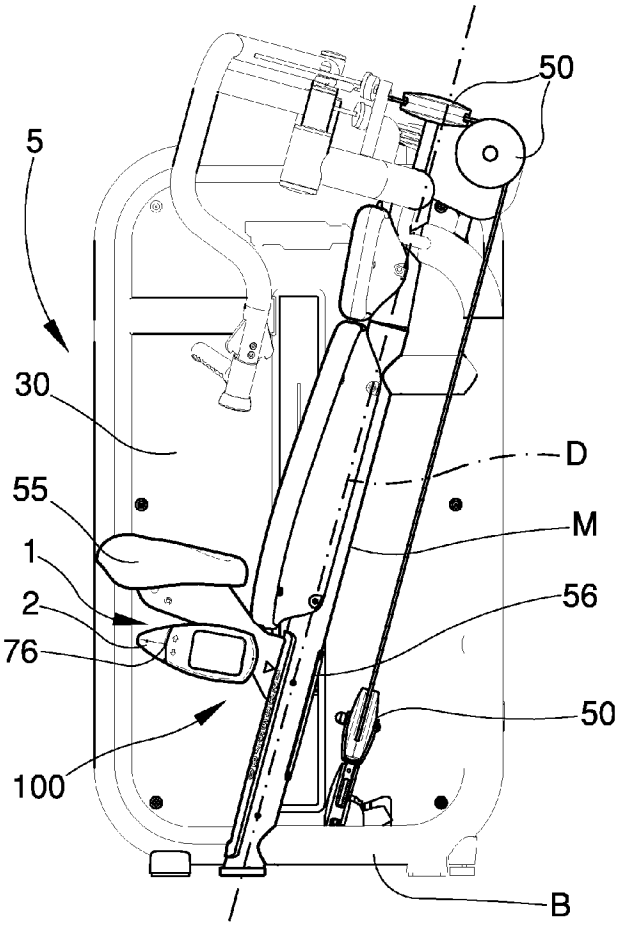
FIG. 6 is a side elevation view of a second gymnastic machine provided with a variant of the regulating member of FIG. 1.

For example, with reference to FIGS. 6 to 8, an application of the regulating member 1 is shown, which is associated with an operating unit 100 of different type than that described above and associated with a gymnastic machine 5 of the type usually called chest press. In particular, this regulating member 1 differs from that illustrated above in that it is designed to be associated with an operating unit 100 whose frame 10 comprises an elongated member 56 prismatically coupled to the upright M so as to be freely slidable in the direction D and selectively blockable through the pin 72 (FIG. 8). The elongated member 56 rigidly supports a seat 55, usable by a user during a training session with the machine 5. In this version, the pin 72 presents a longitudinal extension increased relative to that of the version described with reference to FIG. 3, as it is easily understood by observing FIGS. 6 and 8, to take into account the greater distance between the switching member 76 and the seat 40 obtained in the upright M.

In view of the above description it is therefore clearly apparent that the regulating members 1 described with reference to FIGS. 1-5 and 6-8 allow releasing the respective operating unit 100 and positioning it in the desired position using one single hand, allowing solving a technical problem that cannot be solved using the teachings deriving from the prior art and therefore overcoming the drawbacks of the prior art. Therefore, the regulating members 1 described with reference to FIGS. 1-5 and 6-8 define a new standard for the construction of these devices, of the operating units 100 embodying them and of the machines 5 embodying these units.

I claim:

1. A regulating member carried by an operating unit provided with a frame coupled in a slidable manner to a support member, said regulating member comprising:

a handle suitable to move said frame longitudinally relative to said support member;

blocking means comprising a first pin movable, against the action of a spring, alternatively between an engagement position and a regulating position transversally to said support member to connect stably said frame to said support member in a longitudinal position definable at will;

wherein said blocking means presents a switching member hinged to said first pin and movable relative to said frame to bring it from said engagement position to said regulating position, transversally to said support member; said handle being connected rigidly to said switching member to actuate said first pin transversally to said support member and to move selectively said frame along said support member with said first pin arranged in said regulating position.

2. A regulating member according to claim 1, comprising constraining means suitable to couple said switching member to said frame; said constraining means comprises at least one pair of slots connected rigidly to said frame and at least one pair of second pins carried integrally by said switching member relative to said frame; each said slot housing transversally a said second pin.

3. A regulating member according to claim 2, wherein each said slot presents a substantially circular shape and being arched as similarly to a distance between said two second pins, so that each said second pin is suitable to define selectively a centre of rotation for the rotation of said switching member relative to said frame.

4. A regulating member according to claim 3, wherein said first pin presents a first longitudinal portion suitable to act as a longitudinal guide for said spring at the side of said switching member and a second longitudinal portion with greater cross section suitable to act as an abutment for said spring at opposite side from said switching member.

5. A regulating member according to claim 4, comprising a sleeve arranged at the side of said switching member transversally to said support member and provided with a through longitudinal seat dimensioned so as to house longitudinally said first portion of said first pin supporting said spring; said sleeve presenting, at the side of said switching member an abutment member provided with a first hole with cross section slightly greater than the transversal dimension of said first portion and slightly less than a cross section of said spring, so as it can be selectively crossed by said first portion of said first pin and it can axially constrain said spring at the side of said switching member.

6. A regulating member according to claim 5, wherein said switching member and said first portion are mechanically connected to each other in a freely rotatable manner about a common axis of rotation.

7. A regulating member according to claim 6, comprising coupling means provided with a second hole obtained in said first portion of said first pin and with at least one slit associated transversally to said switching member in a position substantially symmetric to said median plane of said frame; said coupling means further comprising a key member arranged transversally to said first pin and engaging each said slit to connect stably said switching member and said first pin.

8. A regulating member according to claim 1, wherein said support member comprises a substantially rectilinear upright provided with a plurality of holes suitable to house selectively said pin through a respective free end portion, so as to block said frame in a longitudinal position definable at will.

9. A regulating member according to claim 1, wherein said frame is coupled to said support member in a slidable manner through guiding means comprising a plurality of roller-shaped members; each said roller-shaped member being shaped longitudinally so as to couple transversally to said support member in a substantially conjugated manner.

10. A regulating member according to claim 1, wherein said frame comprises a box-shaped body designed so to surround as a ring said support member; said box-shaped body presenting at the side at least one transverse aperture arranged between said roller-shaped members to make visible a central side portion of said support member, suitable to bring information about the longitudinal position of said frame.

11. A regulating member according to claim 10, wherein said frame comprises a return device carried at opposite side from said handle relative to said upright.

12. A regulating member according to claim 8, wherein said frame comprises an elongated member coupled in a prismatic manner to said upright in a manner that is freely slidable and selectively lockable through said pin; said elongated member rigidly supporting a seat.

13. An operating unit coupled in a slidable manner to an elongated support member provided with a plurality of holes obtained transversally; said operating unit comprising:

a frame supporting a regulating member provided with an handle suitable to move said frame longitudinally relative to said support member;

blocking means comprising a first pin movable, against the action of a spring, alternatively between an engagement position and a regulating position transversally to said support member to connect stably said frame to said support member in a longitudinal position definable at will; wherein said blocking means presents a switching member hinged to said first pin and movable relative to said frame to bring it from said engagement position to said regulating position, transversally to said support member; said handle being connected rigidly to said switching member to actuate said first pin transversally to said support member and to move selectively said frame along said support member with said first pin arranged in said regulating position.

14. An operating unit according to claim 13, comprising constraining means suitable to couple said switching member to said frame; said constraining means comprising at least one pair of slots connected rigidly to said frame and at least one pair of second pins carried integrally by said switching member relative to said frame; each said slot housing transversally a said second pin.

15. An operating unit according to claim 14, wherein each said slot presents a substantially circular shape and being arched as similarly to a distance between said two second pins, so that each said second pin is suitable to define selectively a centre of rotation for the rotation of said switching member relative to said frame.

16. An operating unit according to claim 15, wherein said first pin presents a first longitudinal portion suitable to act as a longitudinal guide for said spring at the side of said switching member and a second longitudinal portion with greater cross section suitable to act as an abutment for said spring at opposite side from said switching member.

17. An operating unit according to claim 16, comprising a sleeve arranged at the side of said switching member transversally to said support member and provided with a through longitudinal seat dimensioned so as to house longitudinally said first portion of said first pin supporting said spring; said sleeve presenting, at the side of said switching member an abutment member provided with a first hole with cross section slightly greater than the transversal dimension of said first portion and slightly less than a cross section of said spring, so as it can be selectively crossed by said first portion of said first pin and it can axially constrain said spring at the side of said switching member.

18. An operating unit according to claim 17, wherein the switching member and said first portion are mechanically connected to each other in a freely rotatable manner about a common axis of rotation.

19. An operating unit according to claim 18, comprising coupling means provided with a second hole obtained in said first portion of said first pin and with at least one slit associated transversally to said switching member in a position substantially symmetric to said median plane of said frame; said coupling means further comprising a key member arranged transversally to said first pin and engaging each said slit to connect stably said switching member and said first pin.

20. An operating unit according to claim 13, wherein said support member comprises a substantially rectilinear upright provided with a plurality of holes suitable to house selectively said pin through a respective free end portion, so as to block said frame in a longitudinal position definable at will.

21. An operating unit according to claim 13, wherein said frame is coupled to said support member in a slidable manner through guiding means comprising a plurality of roller-shaped members; each said roller-shaped member being shaped longitudinally so as to couple transversally to said support member in a substantially conjugated manner.

22. An operating unit according to claim 13, wherein said frame comprises a box-shaped body designed so to surround as a ring said support member; said box-shaped body presenting at the side at least one transverse aperture arranged between said roller-shaped members to make visible a central side portion of said support member, suitable to bring information about the longitudinal position of said operating unit.

23. An operating unit according to claim 22, wherein said frame comprises a return device carried at opposite side from said handle relative to said upright.

24. An operating unit according to claim 20, wherein said frame comprises an elongated member coupled in a prismatic manner to said upright in a manner that is freely slidable and selectively lockable through said pin; said elongated member rigidly supporting a seat.

25. A gymnastic machine provided with a base supporting a load group, which can be actuated through at least one flexible member wound about a plurality of return members and with a support member of prismatic shape, carried rigidly by said base and provided with a plurality of holes obtained transversally; said gymnastic machine further comprising an operating unit coupled in a slidable manner to said elongated support member; said operating unit comprising a frame supporting a regulating member provided with an handle suitable to move said frame longitudinally relative to said support member; blocking means comprising a first pin movable, against the action of a spring, alternatively between an engagement position and a regulating position transversally to said support member to connect stably said frame to said support member in a longitudinal position definable at will; said gymnastic machine being wherein said blocking means present a switching member hinged to said first pin and movable relative to said frame to bring it from said engagement position to said regulating position, transversally to said support member; said handle being connected rigidly to said switching member to actuate said first pin transversally to said support member and to move selectively said frame along said support member with said first pin arranged in said regulating position.

* * * * *